US006417471B1

(12) United States Patent
Rompel

(10) Patent No.: US 6,417,471 B1
(45) Date of Patent: Jul. 9, 2002

(54) DEVICE FOR RECOGNIZING COINS

(75) Inventor: Wolfgang Rompel, Berlin (DE)

(73) Assignee: F. Zimmerman GmbH & Co., KG, Berlin (DE)

( * ) Notice: Subject to any disclaimer, the term of this patent is extended or adjusted under 35 U.S.C. 154(b) by 0 days.

(21) Appl. No.: 09/520,863

(22) Filed: Mar. 7, 2000

(30) Foreign Application Priority Data

Mar. 8, 1999 (DE) ..... 199 09 851

(51) Int. Cl.[7] ..... G07C 5/00; G07D 5/00

(52) U.S. Cl. ..... 209/577; 209/587; 209/938; 194/328

(58) Field of Search ..... 209/576, 579, 209/587, 938, 577; 194/206, 207, 208, 209, 317, 328

(56) References Cited

U.S. PATENT DOCUMENTS 4,577,744 A * 3/1986 Doucet ..... 194/318
5,522,491 A * 6/1996 Baudat et al. ..... 194/207
5,538,123 A * 7/1996 Tsuji ..... 194/328 X
6,142,285 A * 11/2000 Panzeri et al. ..... 194/328

FOREIGN PATENT DOCUMENTS

| | | | | |
|---|---|---|---|---|
| EP | 546341 | * | 11/1992 | ..... 194/328 |
| GB | 2227347 | * | 7/1990 | ..... 194/328 |
| JP | 5-046840 | * | 2/1993 | ..... 194/328 |

* cited by examiner

*Primary Examiner*—Tuan N. Nguyen
(74) *Attorney, Agent, or Firm*—Millen, White, Zelano & Branigan, P.C.

(57) ABSTRACT

Device for recognizing coins based on their di-electric surface properties by radiating electromagnetic radiation by a transmitter onto a coin, which is reflected from the surface of the coin and received by a receiver which transforms the reflected electromagnetic radiation into a measuring signal, said signal is then evaluated by an evaluator unit in which a wavelength-selective evaluating signal is generated and compared to wavelength-selective comparison bands.

43 Claims, 3 Drawing Sheets

DEVICE FOR RECOGNIZING COINS

SPECIFICATION

Figure 1:
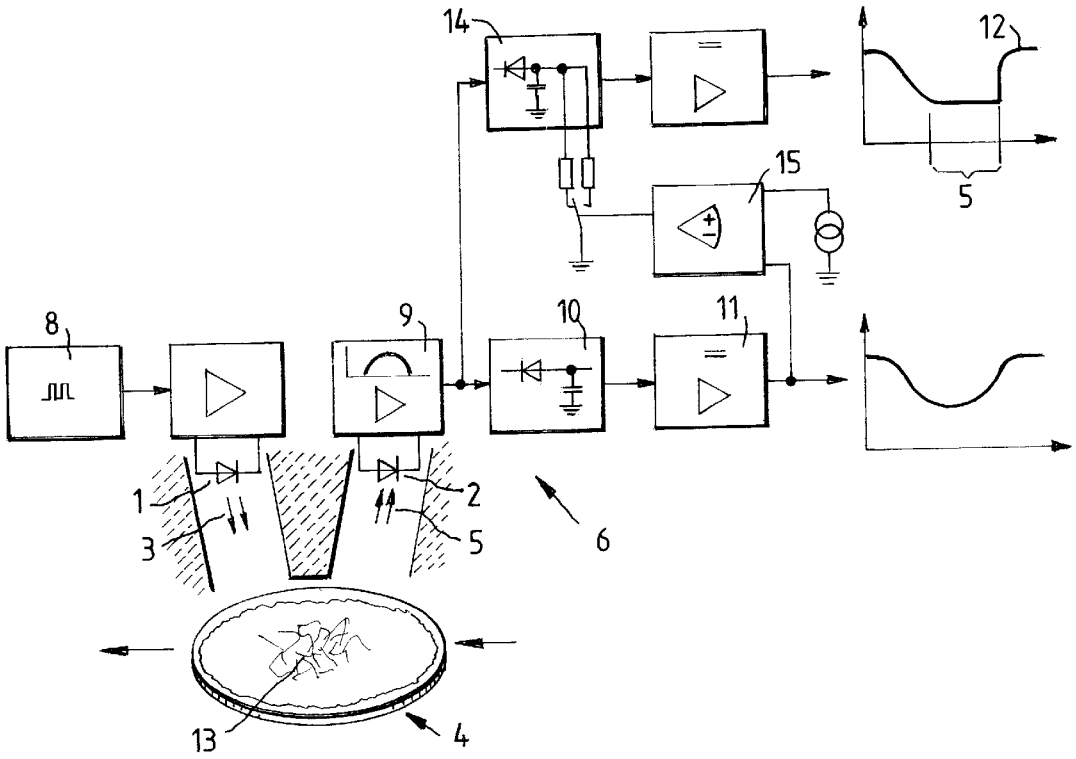
Figure 2A:
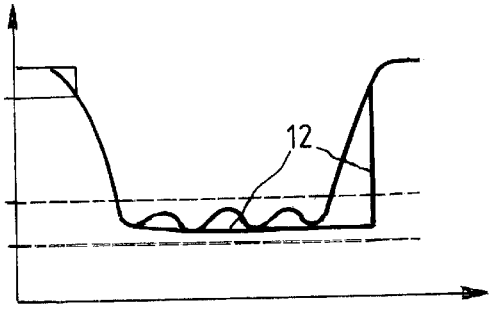
Figure 2B:
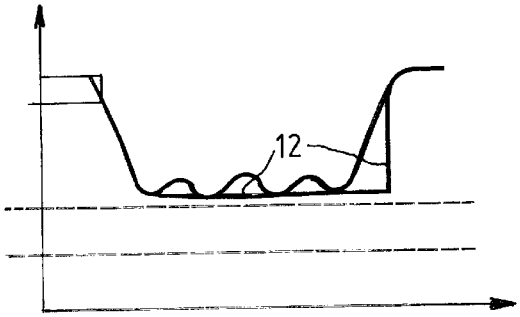
Figure 2C:
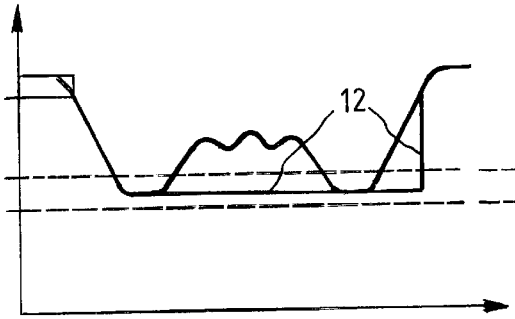
Figure 2D:
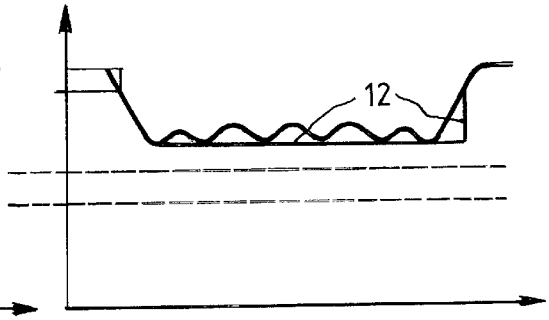

The present invention relates to a device for recognizing coins, comprising a transmitter element for electro-magnetic radiation, a receiver element for electro-magnetic radiation, by means of which an electrical measuring signal corresponding to the incoming radiation is generated, the arrangement of said transmitter and receiver elements being made such that electro-magnetic radiation emitted by said transmitter element acts on a coin brought into a test position and that at least part of the reflected radiation of the incoming electro-magnetic radiation reflected by the coin acts on said receiver element, and comprising an evaluator unit connected to said receiver element, by means of which by comparison of the electrical measuring signal generated by said receiver element and possibly electronically further processed to a given comparison signal a "false" control signal or a "true" control signal can be generated. A device for recognizing coins serves for differentiation between false and true coins and for differentiation between true, however different coins. Coins recognized as false will be fed to a separate collector system. True however different coins are sorted. Of course, both functions can be combined. In the case of sorting, in the simplest case,. the "true" control signal corresponds for instance to a "correct" control signal to be sorted, and the "false" control signal would correspond to coin types not to be sorted. In case of sorting, of course more than two alternative comparison signals, and control signals may exist, then one control signal being assigned to each coin type or group of coin types. The term electro-magnetic radiation comprises for instance wavelength ranges from the cm range to the mm range. In particular the range of the visible light, near u.v. light and near and far i.r. light can be used. If electro-magnetic radiation hits a border surface, for instance a solid body surface, the radiation will interact with the solid body. Depending of the entering angle and the di-electric properties of the solid body, at least part of the intensity, in case of a total reflection the complete incoming radiation will be reflected, the degree of reflectivity further depending on the angle between incoming radiation and surface normal of the solid body. In this context, reference is made to basic physical publications about reflection.

A device of the design referred to hereinbefore is known from document DE 195 07 482 A1. In the so far prior art device, visible light is radiated on a surface of a coin, and the reflected light is detected by means of a lens-optical system in the manner of a picture as an electrical signal or a data set, resp. The electrical signal or the data set thereof, resp., corresponding to a picture is compared to a reference data set, and thus a comparison between a "given picture" and an "actual picture" is performed. In case of deviations, a "false" signal is generated. In other words, the prior art device operates with an optical pattern recognition system performing comparisons to given patterns. This procedure is very expensive with regard to data technology or software, resp. Further, geometrical operations have to be performed with the detected optical patterns, since the position of a coin at pattern recognition cannot easily be reproducibly determined. Moreover, it is difficult to find criteria for the admissible degree of pattern deviations which will still permit reliable selections or assignments of the coins. In the reference document cited above, further an evaluation of brightness values for differentiation between alloys is mentioned, this is however per se little reliable for instance due to the different oxidation degrees of coin surfaces.

Given this prior art, it is the technical aim of the invention to provide a device for recognizing coins that operates in a simpler way however at high reliability.

For achieving this aim, the invention teaches that a wavelength-selective measuring and evaluating signal can be produced in the receiver element and the evaluator unit, and that the control signals can be produced by the evaluator unit according to a comparison of the wavelength-selective evaluating signal to given wavelength-selective comparison signal bands. The term wavelength-selective means that not a broad spectrum of electro-magnetic radiation is detected, but rather a small band only. In the case of light this means that for instance only one color is detected, corresponding to a line width $\Delta\lambda/\lambda$($\lambda$=wavelength with maximum radiation intensity, $\Delta\lambda$=line width at 0.5 times maximum radiation intensity) of less than 0.4, preferably 0.2, for instance approx. 0.1 to 0.06. A wavelength-selective measuring signal can be achieved in the receiver element by way of the wavelength-selective radiation from the transmitter element and/or of the wavelength-selective detection in the receiver unit. A wavelength-selective measuring signal can be obtained on the detection side by various methods. For instance, the receiver element may include a wavelength-selective sensor or be provided with a wavelength-selective filter in front of a sensor. In this case, the receiver unit needs not to operate in a wavelength-selective manner. It is further possible to modulate a wavelength-selective electro-magnetic radiation coming from a transmitter element, and to establish by de-modulation in a not or only slightly wavelength-selective receiver element or in ad evaluator unit arranged therebehind a specific assignment to the emitted electro-magnetic radiation. A comparison signal band is a given measuring and evaluating signal range, in particular a signal intensity range, being assigned to coin conditions "false" or "true", measuring and evaluating signals outside this signal range being assigned to the respectively other coin condition. In principle, both borders of the comparison s signal band are sharp, however there can be provided subsections at the borders being assigned to a coin condition "not sure". The comparison signal band or its borders or border sections, resp., can easily be determined by tests with true and false coins. Corresponding conditions apply to an embodiment having a (if applicable, additional) sorting function.

The invention is initially based on the fact that total reflection will not always and in a wavelength-independent manner occur at metal surfaces in the sense that the degree of reflection is precisely 100%. Rather various absorption processes take place, said absorption processes being wavelength-dependent. On the one hand, the wavelength dependencies of the dielectric constant of the body material, in particular however, on the other hand, the electronic properties of surface layers, as for instance oxide layers, are responsible for this. Said oxide layers will affect reflectivity to a substantial extent and in a wavelength-dependent manner, depending on chemical composition. Absorption and thus also reflection are thus substantially determined by the material of the coins. Thus, by adjustment of the wavelength and maybe of the entering angle of the radiation, a particularly safe differentiation with regard to coins of different chemical composition can be achieved, and this practically independent from the degree of oxidation of the coin. As a result, the optical device according to the invention operates in a particularly simple manner (no pattern recognition required), and nevertheless in a particularly reliable manner.

In principle, a wavelength-selective measuring signal can be obtained, if the transmitter element can emit electromagnetic radiation in a wavelength-selective manner, and/or the receiver element can receive electro-magnetic radiation in a wavelength-selective manner. A particularly simple and reliable embodiment of the invention is characterized by that the transmitter element comprises a luminescence diode. Luminescence diodes are p-n semiconductor elements with a material-dependent band gap. The measure of the band gap to determines the wavelength of the emitted radiation. Examples are: GaAs, Si-doted: IR; GaP, Zn—, O-doted: red; $GaAs_{0.6}P_{0.4}$: red; .$GaAs_{0.35}P_{0.65}$, n-doted: orange; $GaAs_{0.15}P_{0.85}$, n-doted: yellow; GaP, n-doted: green; SiC, A1—, n-doted: blue; GaN, Zn-doted: blue. The line width is typically approx. 40 nm.

A special embodiment of the invention is characterized by that the transmitter element comprises several transmitter units emitting in a wavelength-selective manner, the radiation spectra of said transmitter units being non-overlapping, and that in the receiver element preferably separate, to one transmitter unit each assignable measuring signals can be produced. Non-overlapping means that the wavelengths of the radiation intensity peaks differ by more than half the line width. For instance, from the luminescence diodes mentioned above, two types of different colors, i.e. of different band gaps, may be used, also in one constructional unit.

By operating at two different wavelengths, an again enhanced reliability is achieved, since the wavelength, selective reflection properties of a certain material are each individually important at different wavelengths. However, an evaluator unit only totaling with regard to the measuring signals may also be employed; i.e. without separate measuring signals.

Preferably, the transmitter element is designed to emit modulated electro-magnetic waves. Modulated means amplitude-modulated, for instance with a square-wave or sinusoidal envelope. The modulation frequency may vary in the range from 50 Hz to 20 MHz, preferably from 50 Hz to 1 MHz, most preferably from 200 Hz to 20 kHz. In the embodiment for instance comprising two different-color luminescence diodes, these may be provided with different modulations to be discriminated in the receiver element or in the evaluator unit, for instance different modulation frequencies. By means of the modulation, influences by foreign light or day light are practically excluded in every embodiment.

The receiver element may comprise a photo-resistor, a p-n photo-diode, a pin photo-diode, an avalanche photo-diode or a photo-transistor. The two latter components are detectors having an internal amplification. The spectral efficiency of the above components is relatively wavelength-inselective, compared to the emission spectrum of for instance luminescence diodes.

The transmitter and receiver elements are orientated such the directions of maximum radiation intensity and of maximum efficiency are each arranged identically or differently at an angle of 0 to 50°, preferably 5 to 30°, most preferably 14 to 16°, to the normal on a main coin surface. The latter angle range is recommended in particular for the case of lead-containing coins and in conjunction with yellow or orange light. For other coin metals, other angle ranges may be provided, combined with other colors, and may be optimized by simple tests in a metal-specific or alloy-specific manner.

A special embodiment of the invention is characterized by that the transmitter element comprises an oscillator for modulating the emitted electro-magnetic radiation, and that the evaluator unit comprises an a.c. amplifier for amplifying the measuring signal, preferably with a filter, a detector for demodulating the measuring signal, preferably t rectifier, and a d.c. amplifier for amplifying the demodulated signal and a comparator for comparing the demodulated signal to a given d.c. range. The given d.c. range is coin or alloy-specific, and can. be determined for instance by measurements on reference coins. The output signal of the comparator can directly be used as a "false" or "true" control signal. It is however also possible to use the comparator signal (usually a binary signal, i.e. for instance "1" for a measuring signal being within the given d.c. signal, otherwise "0") for controlling a sample/hold circuitry. This may consist of a (another) rectifier detector and the actual sample/hold circuitry being controlled by the comparator. Said rectifier detector is connected parallely to the input of the rectifier detector connected upstream the comparator. The amplified (if necessary) output signal is then fed to a (another) comparator for generating the "false" or "true" control signal.

The invention also relates to a method for testing coins, wherein electro-magnetic radiation is emitted by a transmitter element on a coin, wherein the emitted electro-magnetic radiation is reflected from the surface of the coin, and wherein the reflected electro-magnetic radiation is received and transformed into an electrical measuring signal by a receiver element, the measuring signal being fed to an evaluator unit and compared to a given comparison signal, and according to the result of such comparison a "false" control signal or a "true" control signal being generated, and is characterized by that preferably the emitted electro-magnetic radiation has a line width $\Delta\lambda/\lambda$ of less than 0.4, and that in the evaluator unit a wavelength-selective evaluating signal, preferably in the range of the line width of the emitted electro-magnetic radiation, is generated and compared to wavelength-selective comparison signal bands. The above functional explanations given with regard to the device according to the invention are to be employed in corresponding manner. In detail it is preferred if the line width is less than 0.2, preferably less than 0.1, most preferably less than 0.07.

Figure 3:
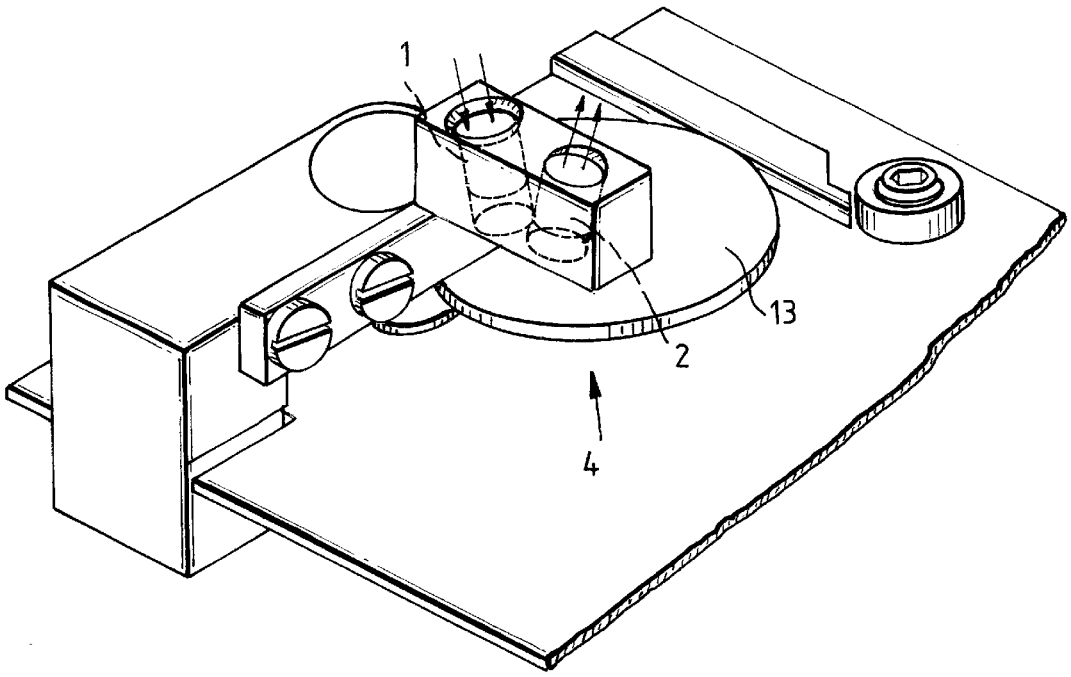

In the following, the invention will be described in more detail, with reference to only one embodiment as represented in the drawings. There are:

FIG. 1 a diagramninatical representation of a device according to the invention, FIGS. 2*a* to 2*d*: typical input signals for a comparator generating a "false" and "true" control signal, and FIG. 3 a practical embodiment of the transmitter and receiver elements.

Referring now to FIG. 1, there is shown a diagrammatical representation of a device for recognizing coins according to the invention. This device will usually be configured as 4 coin counting and/or coin sorting machine. Such machine; are known in the art. For understanding FIG. 1, it is only important to know that by such machines, coins can be conveyed individually and by means of transportation devices to other devices that can recognize coins. Such machines sort out false coins not belonging to a given coin type and collect them separately, In FIG. 1 firstly can be seen a transmitter element 1 for electro-magnetic radiation and a receiver element 2, for electro-magnetic radiation, which can generate an electrical measuring signal according to the incoming radiation. Transmitter element 1 is a luminescence diode emitting in: yellow or orange color. Hereby brass or bronze-colored coins 4 can particularly well be detected. Receiver element 2 is a photo-transistor.

In particular from FIG. 3 can be taken that the arrangement of transmitter element 1 and of receiver element 2 has been selected such that the electro-magnetic radiation 3 emitted from transmitter element 1 is radiated on a coin 4 brought into a test position, and that the reflection radiation 5 emitted from coin 4 radiates on receiver element 2. Transmitter element 1 and receiver element 2 are orientated in such a way that the directions of maximum radiation intensity and of maximum efficiency are each arranged at an angle of 15° to the normal on a main coin surface 13.

From FIG. 1 can further be seen that an electronic evaluator unit 6 connected to receiver element 2 is provided, by means of which according to a comparison of the electrical measuring signal generated by receiver element 2 and further processed to an evaluating signal 12, to a given comparison signal 7, alternatively a "false" control signal or a "true" control signal can be produced. Since radiation takes place with a modulated luminescence diode, the measuring and evaluating signal is wavelength-selective, after demodulation. In evaluator unit 6, the control signals are produced according to a comparison of the wavelength-selective evaluating signal 12 to given waves length-selective comparison signal bands 7. In detail, transmitter element 1 comprises an oscillator 8 for modulating the emitted electro-magnetic radiation 3. Evaluator unit 6 comprises an a.c. amplifier 9 for amplifying the measuring signal, preferably with a filter, a detector 10 for demodulating the measuring signal, preferably a rectifier, and a d.c. amplifier 11 for amplifying the demodulated signals and a comparator not shown for clarity reasons in FIG. 1, for comparing the demodulated evaluating signal 12 to a given d.c. range (7). It has to be observed, here, that in the shown embodiment the output signal of the d.c. amplifier 11 does not immediately form the evaluating signal 12. Rather this output signal is used for controlling a comparator in turn controlling a combination 14 of a detector (another one and connected in parallel to the input side of above detector 10) and a sample-hold circuitry. The output signal of the sample-hold circuitry is the evaluating signal 15, if necessary after d.c. amplification.

In FIG. 2 various evaluating signals 12 and comparison signal bands 7 for a specific coin type are shown. FIG. 2*a* shows the signals for a: true mono-color coin, since the evaluating signal 12 is, after sampling by the sample-hold circuitry, in the comparison signal band 7. A subsequent comparator then generates a "true" control signal. If a false coin or a coin of a different coin type are among the coins to be tested according to FIG. 2*a*, for instance an evaluating signal 7 according to FIG. 2*b* is obtained, with the consequence of a "false" control signal. With the device according to the invention, bi-color coins can also be tested, as shown in FIGS. 2*c* and 2*d*. The, statements given with regard to FIGS. 2*a* and 2*b* are valid her; in a corresponding manner. In the embodiment, testing is concentrated on the outer periphery of the coin.

What is claimed is:

1. A device for recognizing coins, comprising a transmitter element emitting electro-magnetic radiation, a receiver element for electro-magnetic radiation, by means of which an electrical measuring signal corresponding to an incoming electro-magnetic radiations generated, the arrangement of said transmitter and receiver elements being such that part of the electro-magnetic radiation emitted by said transmitter element is reflected from the surface of a coin brought into a test position as reflected electro-magnetic radiation, the reflected electro-magnetic radiation is received and transformed into a measuring signal by the receiver element further comprising an evaluator unit connected to said receiver element in which a wavelength-selective evaluating signal is generated and compared to wavelength selective comparison signal bands for comparing the electrical measuring signal generated by the receiver element and further processed to a wave-length selective evaluating signal, to a given comparison signal, and according to the result of such comparison generating a "false" control signal or a "true" control signal.

2. A device according to claim 1, in which the transmitter element can emit electro-magnetic radiation in a wave-length-selective manner, or the receiver element can receive electro-magnetic radiation in a wave-length selective manner.

3. A device according to claim 1 in which the transmitter element comprises a luminescence diode.

4. A device according to claims 1 in which the transmitter element comprises several transmitter units emitting in a wavelength-selective manner, the radiation spectra of said transmitter units being non-overlapping, and the receiver element preferably separate, to one transmitter unit each assignable measuring signals can be produced.

5. A device according to claims 1 in which the transmitter element comprises two luminescence diodes of different band gaps.

6. A device according claims 1 in which the transmitter element radiates modulated electro-magnetic waves.

7. A device according to claim 1 in which the receiver element comprises a photo-resistor, a p-n photo-diode, a pin photo-diode, an avalanche photo-diode or a photo-transistor.

8. A device according to claims 1 in which the transmitter element and receiver element are orientated such that the directions of maximum radiation intensity and of maximum efficiency are each arranged identically or differently at an angle of 0 to 50°, to the normal on a main coin surface .

9. A device according to claims 1 in which the transmitter element comprises an oscillator for modulating the emitted electro-magnetic radiation, and the evaluator unit comprises an a.c. amplifier for amplifying the measuring signal, a detector for demodulating the measuring signal, a d.c. amplifier for amplifying the demodulated signal and a comparator for comparing a demodulated evaluating signal to a given d.c. range.

10. A device according to claim 2, in which the transmitter element comprises a luminescence diode.

11. A device according to claim 2, in which the transmitter element comprises several transmitter units emitting in a wavelength-selective manner, the radiation spectra of said transmitter units being non-overlapping, and the receiver element preferably separate, to one transmitter unit each assignable measuring signals can be produced.

12. A device according to claim 3, in which the transmitter element comprises several transmitter units emitting in a wavelength-selective manner, the radiation spectra of said transmitter units being non-overlapping, and the receiver element preferably separate, to one transmitter unit each assignable measuring signals can be produced.

13. A device according to claim 2, in which the transmitter element comprises two luminescence diodes of different band gaps.

14. A device according to claim 3, in which the transmitter element comprises two luminescence diodes of different band gaps.

15. A device according to claim 4, in which the transmitter element comprises two luminescence diodes of different band gaps.

16. A device according to claim 2, in which the transmitter element is designed to radiate modulated electro-magnetic waves.

17. A device according to claim 3, in which the transmitter element is designed to radiate modulated electro-magnetic waves.

18. A device according to claim 4, in which the transmitter element is designed to radiate modulated electro-magnetic waves.

19. A device according to claim 5, in which the transmitter element is designed to radiate modulated electro-magnetic waves.

20. A device according to claim 2, in which the receiver element comprises a photo-resistor, a p-n photo-diode, a pin photo-diode, an avalanche photo-diode or a photo-transistor.

21. A device according to claim 3, in which the receiver element comprises a photo-resistor, a p-n photo-diode, a pin photo-diode, an avalanche photo-diode or a photo-transistor.

22. A device according to claim 4, in which the receiver element comprises a photo-resistor, a p-n photo-diode, a pin photo-diode, an avalanche photo-diode or a photo-transistor.

23. A device according to claim 5, in which the receiver element comprises a photo-resistor, a p-n photo-diode, a pin photo-diode, an avalanche photo-diode or a photo-transistor.

24. A device according to claim 6, in which the receiver element comprises a photo-resistor, a p-n photo-diode, a pin photo-diode, an avalanche photo-diode or a photo-transistor.

25. A device according to claim 2, in which the transmitter element and receiver element are orientated such that the directions of maximum radiation intensity and of maximum efficiency are each arranged identically or differently at an angle of 0 to 50° to the normal on a main coin surface.

26. A device according to claim 3, in which the transmitter element and receiver element are orientated such that the directions of maximum radiation intensity and of maximum efficiency are each arranged identically or differently at an angle of 0 to 50° to the normal on a main coin surface.

27. A device according to claim 4, in which the transmitter element and receiver element are orientated such that the directions of maximum radiation intensity and of maximum efficiency are each arranged identically or differently at an angle of 0 to 50°t to the normal on a main coin surface.

28. A device according to claim 5, in which the transmitter element and receiver element are orientated such that the directions of maximum radiation intensity and of maximum efficiency are each arranged identically or differently at an angle of 0 to 50° to the normal on a main coin surface.

29. A device according to claim 6, in which the transmitter element and receiver element are orientated such that the directions of maximum radiation intensity and of maximum efficiency are each arranged identically or differently at an angle of 0 to 50° to the normal on a main coin surface.

30. A device according to claim 7, in which the transmitter element and receiver element are orientated such that the directions of maximum radiation intensity and of maximum efficiency are each arranged identically or differently at an angle of 0 to 50° to the normal on a main coin surface.

31. A device according to claim 2, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

32. A device according to claim 3, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

33. A device according to claim 4, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

34. A device according to claim 5, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

35. A device according to claim 6, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

36. A device according to claim 7, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

37. A device according to claim 8, in which the transmitter element comprises an oscillator for modulating the emitted electro-magnetic radiation, and the evaluator unit comprises an a.c. amplifier for amplifying the measuring signal, a detector for demodulating the measuring signal and a d.c. amplifier for amplifying the demodulated signal and a comparator for comparing a demodulated evaluating signal to a given d.c. range.

38. A device for recognizing coins according to claim 1, wherein the reflected electromagnetic radiation from the surface of the coin is wavelength dependent on the dielectric properties of the coin.

39. A device for recognizing coins according to claim 1, wherein the reflected electromagnetic radiation from the surface of the coin is wavelength dependent on the electronic properties of the surface layer of the coin.

40. A method for testing coins in which electro-magnetic radiation is emitted by a transmitter element onto a coin, part of the electro-magnetic radiation is reflected from the surface of the coin as reflected electro-magnetic radiation, the reflected electro-magnetic radiation is received and transformed into an electrical measuring signal by a receiver element, the electrical measuring signal is fed into an evaluator unit, in which a wavelength-selective evaluating signal is generated and compared to wavelength-selective comparison bands, and compared to a given comparison signal, and according to the result of such comparison a "false" control signal or a "true" control signal is generated.

41. A method according to claim 40 in which the line width is less than 0.2.

42. A method for recognizing coins according to claim 40, wherein the reflected electromagnetic radiation from the surface of the coin is wavelength dependent on the dielectric properties of the coin.

43. A method for recognizing coins according to claim 40, wherein the reflected electromagnetic radiation from the surface of the coin is wavelength dependent on the electronic properties of the surface layer of the coin.

* * * * *

UNITED STATES PATENT AND TRADEMARK OFFICE

CERTIFICATE OF CORRECTION

PATENT NO. : 6,417,471 B1
DATED : July 9, 2002
INVENTOR(S) : Wolfgang Rompel

It is certified that error appears in the above-identified patent and that said Letters Patent is hereby corrected as shown below:

Title page,
Item [73], Assignee, "Zimmerman" should read -- Zimmermann --

Column 5,
Line 59, "radiations" should read -- radiation is --

Column 6,
Lines 15, 21, 24, 29 and 34, "claims" should read -- claim --
Line 18, "non-overlapping," should read -- non-overlapping --

Column 7,
Line 39, "50°t to" should read -- 50° to --

Signed and Sealed this

Twenty-first Day of June, 2005

JON W. DUDAS
*Director of the United States Patent and Trademark Office*